US009860968B2

(12) United States Patent
Ikeda

(10) Patent No.: US 9,860,968 B2
(45) Date of Patent: Jan. 2, 2018

(54) PLASMA GENERATING DEVICE, AND INTERNAL COMBUSTION ENGINE

(75) Inventor: Yuji Ikeda, Kobe (JP)

(73) Assignee: IMAGINEERING, INC., Hyogo (JP)

( * ) Notice: Subject to any disclaimer, the term of this patent is extended or adjusted under 35 U.S.C. 154(b) by 665 days.

(21) Appl. No.: 14/345,580

(22) PCT Filed: Sep. 12, 2012

(86) PCT No.: PCT/JP2012/073380

§ 371 (c)(1),
(2), (4) Date: Nov. 18, 2014

(87) PCT Pub. No.: WO2013/042597

PCT Pub. Date: Mar. 28, 2013

(65) Prior Publication Data

US 2015/0068479 A1 Mar. 12, 2015

(30) Foreign Application Priority Data

Sep. 22, 2011 (JP) ..... 2011-207253

(51) Int. Cl.
*H05H 1/46* (2006.01)
*F02P 3/01* (2006.01)
*F02P 23/04* (2006.01)

(52) U.S. Cl.
CPC ..... *H05H 1/46* (2013.01); *F02P 3/01* (2013.01); *F02P 23/045* (2013.01); *H05H 2001/463* (2013.01)

(58) Field of Classification Search
CPC . F02P 23/04; F02P 23/045; F02P 3/01; H01T 13/40; H01T 13/50; H05H 1/46; H05H 2001/463

(Continued)

(56) References Cited

U.S. PATENT DOCUMENTS 4,499,872 A * 2/1985 Ward ..... F01L 13/00 123/344
5,350,454 A * 9/1994 Ohkawa ..... C23C 16/4401 118/723 E (Continued)

FOREIGN PATENT DOCUMENTS

EP 1154459 A2 11/2001
EP 1220281 A2 7/2002

(Continued)

OTHER PUBLICATIONS

160107 X JP 2006-132518 machine Translation w Drawings.*
International Search Report, dated Jan. 29, 2013, issued in corresponding application No. PCT/JP2012/073380.

*Primary Examiner* — Carlos A Rivera
*Assistant Examiner* — Carl Staubach
(74) *Attorney, Agent, or Firm* — Westerman, Hattori, Daniels & Adrian, LLP

(57) ABSTRACT

To simplify a configuration of a plasma generation device that generates plasma by means of an electromagnetic wave using thermal electrons as a trigger. The plasma generation device 30 includes: a thermal electron emission member 14 that emits thermal electrons when heated; a heating device 13 that heats the thermal electron emission member 14 by means of an electromagnetic wave; and an electric field concentration member 61 that concentrates in the vicinity of the thermal electron emission member 14 an electric field of the electromagnetic wave generated by the heating device 13. The plasma generation device 30, while causing the heating device 13 to heat the thermal electron emission member 14, causes the electric field concentration member 61 to concentrate the electric field of the electromagnetic wave in the vicinity of the thermal electron emission member 14, thereby generating plasma in the vicinity of the thermal electron emission member 14.

10 Claims, 7 Drawing Sheets

(58) Field of Classification Search
USPC ..... 123/143 B, 536, 538, 539
See application file for complete search history.

(56) References Cited

U.S. PATENT DOCUMENTS

| | | | | |
|---|---|---|---|---|
| 5,457,298 | A * | 10/1995 | Nelson | H01J 37/32082 156/345.46 |
| 6,710,524 | B2 * | 3/2004 | Gibson | H01J 37/32009 118/723 E |
| 8,033,273 | B2 * | 10/2011 | Kato | F02P 9/007 123/596 |
| 8,552,650 | B2 * | 10/2013 | Ikeda | H01J 37/32192 118/723 AN |
| 9,347,422 | B2 * | 5/2016 | Ikeda | F02P 9/007 |
| 2002/0008451 | A1 * | 1/2002 | Gibson | H01J 37/32009 313/231.31 |
| 2002/0122897 | A1 | 9/2002 | Namiki et al. | |
| 2007/0283916 | A1 * | 12/2007 | Bachmaier | H01T 13/20 123/143 B |
| 2010/0192909 | A1 | 8/2010 | Ikeda | |
| 2012/0007503 | A1 * | 1/2012 | Kim | H01J 37/3211 315/34 |
| 2014/0014050 | A1 * | 1/2014 | Ikeda | F02P 9/007 123/3 |
| 2014/0076257 | A1 * | 3/2014 | Ikeda | F02B 23/08 123/143 B |
| 2014/0190438 | A1 * | 7/2014 | Ikeda | F02P 3/01 123/146.5 R |
| 2014/0216380 | A1 * | 8/2014 | Ikeda | F02P 23/045 123/143 B |
| 2014/0216381 | A1 * | 8/2014 | Ikeda | H05H 1/46 123/143 B |
| 2015/0068479 | A1 * | 3/2015 | Ikeda | F02P 3/01 123/143 B |

FOREIGN PATENT DOCUMENTS

| | | | | |
|---|---|---|---|---|
| EP | 2180177 | A1 | 4/2010 | |
| JP | 2001-358000 | A | 12/2001 | |
| JP | 2002-275635 | A | 9/2002 | |
| JP | 2003-229300 | A | 8/2003 | |
| JP | 2003-317999 | A | 11/2003 | |
| JP | 2006-132518 | A | 5/2006 | |
| JP | 2009-287549 | A | 12/2009 | |
| JP | 2010-096109 | A | 4/2010 | |
| JP | 2006-132518 | * | 6/2016 | F02P 3/01 |

* cited by examiner

PLASMA GENERATING DEVICE, AND INTERNAL COMBUSTION ENGINE

TECHNICAL FIELD

The present invention relates to a plasma generation device that generates plasma by means of an electromagnetic wave using thermal electrons as a trigger, and an internal combustion engine provided with this plasma generation device.

BACKGROUND ART

Conventionally, there is known a technology of generating plasma by means of an electromagnetic wave using thermal electrons as a trigger. For example, Japanese Unexamined Patent Application, Publication No. 2009-287549 discloses a compression ignition type internal combustion engine which this kind of technology is applied to. In this compression ignition type internal combustion engine, thermal electrons are emitted from a surface of a glow plug. A microwave is radiated to a region where the thermal electrons are provided. Then, the thermal electrons receive energy of the microwave and are accelerated. The accelerated thermal electrons collide with ambient molecules and ionize the molecules. Electrons emitted by the ionization are also accelerated by the microwave and collide with ambient molecules and ionize the molecules. Thus, ionization of the molecules by the microwave forms an avalanche, thereby generating microwave plasma.

PRIOR ART DOCUMENT

Patent Documents

Patent Document 1: Japanese Unexamined Patent Application, Publication No. 2009-287549

THE DISCLOSURE OF THE INVENTION

Problems to be Solved by the Invention

In a conventional plasma generation device, plasma is generated using thermal electrons emitted from a glow plug as a trigger. However, at least an electromagnetic wave emission device and a glow plug are required as devices which require electrical wirings.

The present invention has been made in view of the above described circumstances, and it is an object of the present invention to simplify a configuration of a plasma generation device that generates plasma by means of an electromagnetic wave using thermal electrons as a trigger.

Means for Solving the Problems

In accordance with a first aspect of the present invention, there is provided a plasma generation device, including: a thermal electron emission member that emits thermal electrons when heated; a heating device that heats the thermal electron emission member by means of an electromagnetic wave; and an electric field concentration member that concentrates an electric field of the electromagnetic wave generated by the heating device in the vicinity of the thermal electron emission member. The heating device heats the thermal electron emission member to emit thermal electrons, and the electric field concentration member concentrates the electric field of the electromagnetic wave in the vicinity of the thermal electron emission member, thereby generating plasma in the vicinity of the thermal electron emission member.

According to the first aspect of the present invention, the heating device heats the thermal electron emission member by means of the electromagnetic wave. The thermal electron emission member emits thermal electrons. Meanwhile, the electric field concentration member concentrates the electric field in the vicinity of the thermal electron emission member. Therefore, the thermal electrons emitted from the thermal electron emission member receive energy of the electromagnetic wave and are accelerated. The accelerated thermal electrons collide with and ionize ambient molecules. Electrons emitted by the ionization are also accelerated by the electromagnetic wave, and collide with and ionize molecules. In the vicinity of the thermal electron emission member, the electromagnetic wave ionizes the molecules in an avalanche-like manner, thereby generating the plasma. According to the first aspect of the present invention, the electric field concentration member is disposed along with the thermal electron emission member so that the energy of the electromagnetic wave is effectively absorbed by the thermal electrons in the vicinity of the thermal electron emission member.

In accordance with a second aspect of the present invention, in addition to the first aspect of the present invention, the heating device emits the electromagnetic wave to a space where the thermal electron emission member is disposed. The thermal electron emission member includes: an electromagnetic wave absorber that absorbs the electromagnetic wave emitted by the heating device and generates heat; and a thermal electron emitter that emits thermal electrons when heated by the electromagnetic wave absorber that has generated heat. The thermal electron emitter is integrally formed with the electromagnetic wave absorber In accordance with a third aspect of the present invention, in addition to the second aspect of the present invention, the electromagnetic wave absorber constitutes a receiving antenna that resonates with the electromagnetic wave emitted by the heating device and functions as the electric field concentration member.

In accordance with a fourth aspect of the present invention, in addition to the first aspect of the present invention, the heating device includes a heating coil which alternating current power is supplied to, and the heating device is adapted to inductively heat the thermal electron emission member located inside of the heating coil.

In accordance with a fifth aspect of the present invention, there is provided an internal combustion engine, including: a plasma generation device according to any one of the first to fourth aspects of the present invention; and an internal combustion engine main body formed with a combustion chamber. The thermal electron emission member and the electric field concentration member are disposed on a partitioning surface of the combustion chamber in the internal combustion engine main body. The plasma generation device, while causing the heating device to heat and cause the thermal electron emission member to emit thermal electrons, causes the electric field concentration member to concentrate an electric field of the electromagnetic wave in the vicinity of the thermal electron emission member, thereby generating plasma in the vicinity of the thermal electron emission member in the combustion chamber.

In accordance with a sixth aspect of the present invention, in addition to the fifth aspect of the present invention, the plasma generation device includes a plurality of thermal electron emission members arranged in respective regions different from one another on the partitioning surface, and the plasma generation device generates plasma in the vicinities of the respective thermal electron emission members.

In accordance with a seventh aspect of the present invention, in addition to the fifth or sixth aspect of the present invention, at a start-up time of the internal combustion engine main body, the plasma generation device starts heating the thermal electron emission member before a combustion cycle is started in which an air fuel mixture is combusted in the combustion chamber, and generates plasma in the combustion chamber during the combustion cycle.

In accordance with an eighth aspect of the present invention, there is provided a plasma generation device, including: a thermal electron emission member that emits thermal electrons when heated; and a heating device that includes an alternating current power supply and a heating coil to which an alternating current power is supplied from the alternating current power supply, and is adapted to inductively heat the thermal electron emission member which is located inside of the heating coil. The heating device heats the thermal electron emission member to emit thermal electrons, thereby generating plasma inside of the heating coil.

Effect of the Invention

According to the present invention, the electric field concentration member is disposed along with the thermal electron emission member so that the energy of the electromagnetic wave is effectively absorbed by the thermal electrons in the vicinity of the thermal electron emission member. It is configured such that plasma can be generated by the energy of the electromagnetic wave if at least the heating device is provided as a device which necessitates electrical wirings. Accordingly, since a glow plug which has been required for the conventional plasma generation device is not required any more, it is possible to simplify a configuration of a plasma generation device that generates plasma by means of an electromagnetic wave using thermal electrons as a trigger.

Furthermore, according to the third aspect of the present invention, since the electromagnetic wave absorber also serves as the electric field concentration member, it is possible to further simplify the configuration of the plasma generation device.

BEST MODE FOR CARRYING OUT THE INVENTION

Figure 1:
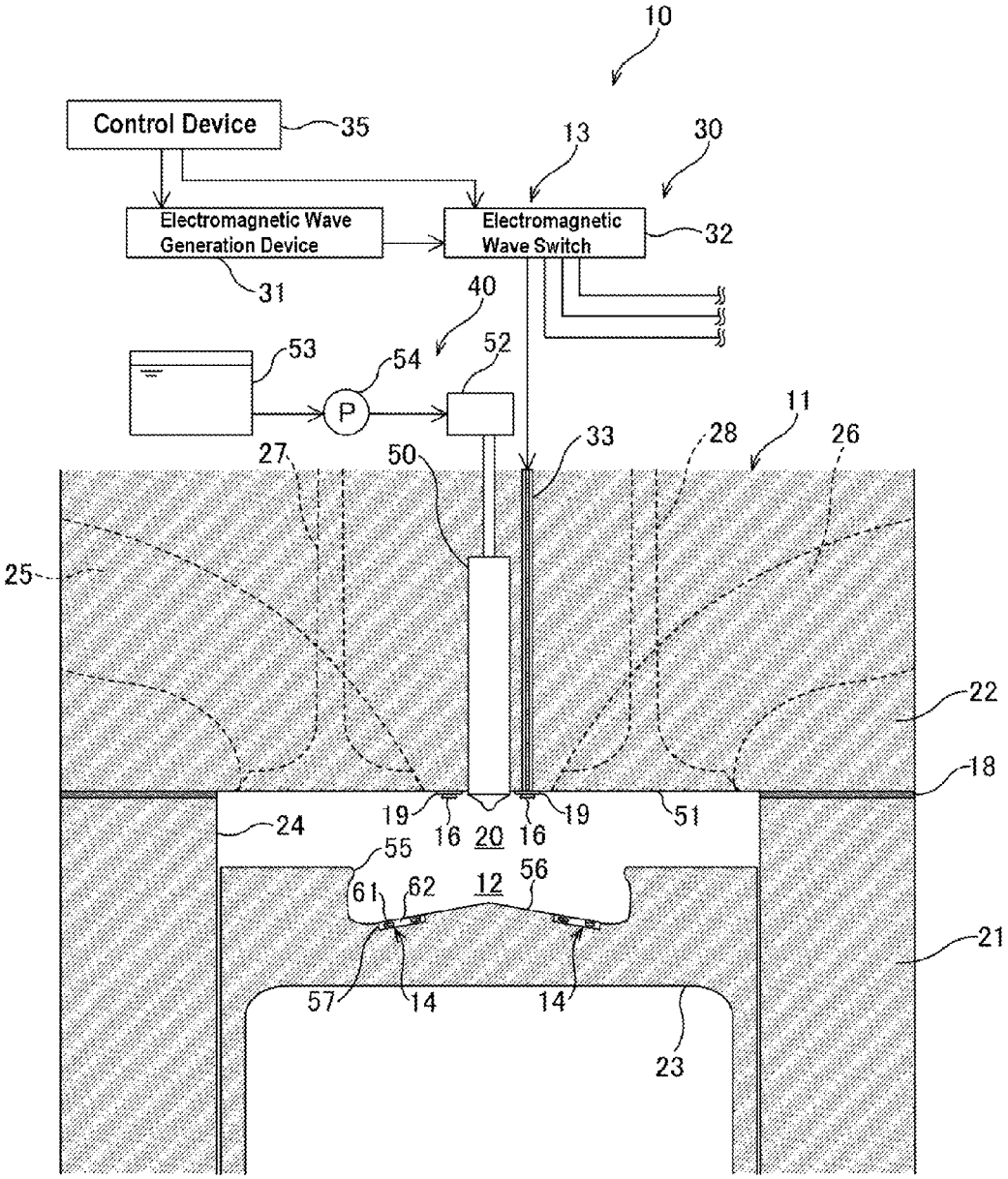
FIG. 1 is a cross sectional view of an internal combustion engine according to a first embodiment.

In the following, a detailed description will be given of embodiments of the present invention with reference to drawings. It should be noted that the following embodiments are merely preferable examples, and do not limit the scope of the present invention, applied field thereof, or application thereof.

First Embodiment

The first embodiment is directed to a compression ignition type internal combustion engine 10 that causes an air fuel mixture to be compression ignited in a combustion chamber 20. The internal combustion engine 10 promotes combustion using microwave plasma. The internal combustion engine 10 includes an internal combustion engine main body 11, a fuel injection device 40, and a plasma generation device 30.

<Internal Combustion Engine Main Body>

As shown in FIG. 1, the internal combustion engine main body 11 includes a cylinder block 21, a cylinder head 22, and pistons 23. The cylinder block 21 is formed with a plurality of cylinders 24 each having a circular cross section. In each cylinder 24, the piston 23 is slidably mounted. The piston 23 is connected to a crankshaft (not shown) via a connecting rod (not shown). The crankshaft is rotatably supported by the cylinder block 21. While the piston 23 reciprocates in each cylinder 24 in an axial direction of the cylinder 24, the connecting rod converts the reciprocal movement of the piston 23 to rotational movement of the crankshaft.

The cylinder head 22 is placed on the cylinder block 21, and a gasket 18 intervenes between the cylinder block 21 and the cylinder head 22. The cylinder head 22 partitions a combustion chamber 20 along with the piston 23 and the cylinder 24. A diameter of the combustion chamber 20 is, for example, approximately equal to a half wavelength of a microwave emitted from an emission antenna 16, which will be described later.

Figure 2:
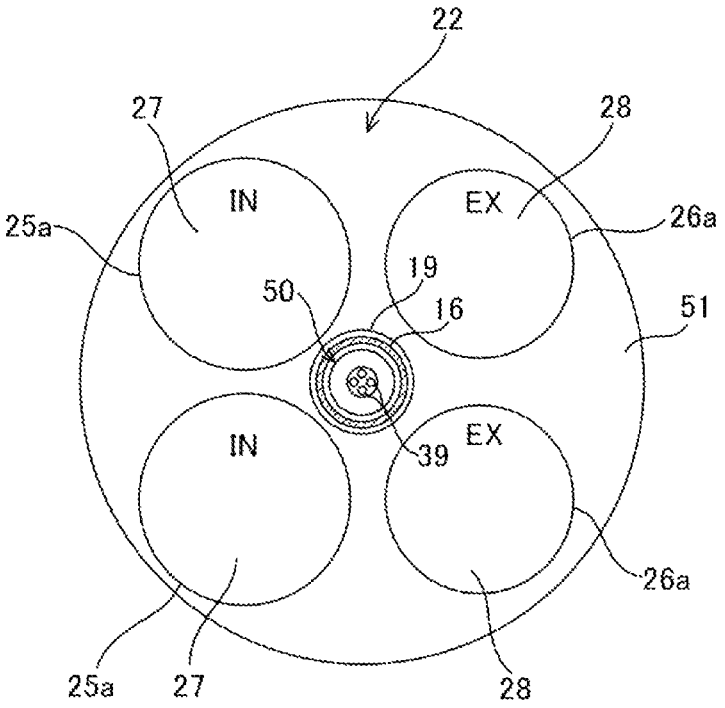
FIG. 2 is a front view of a ceiling surface of a combustion chamber according to the first embodiment.

As shown in FIGS. 1 and 2, in the cylinder head 22, one injector 50 that constitutes a part of the fuel injection device 40, which will be described later, is provided for each cylinder 24. The injector 50 is formed with a plurality of injection holes 39 (four injection holes 39 according to the first embodiment), and is adapted to inject fuel in a radial manner.

The cylinder head 22 is formed with intake ports 25 and exhaust ports 26 for each cylinder 24. Each intake port 25 is provided with an intake valve 27 for opening and closing an intake side opening 25*a* of the intake port 25. On the other hand, each exhaust port 26 is provided with an exhaust valve 28 for opening and closing an exhaust side opening 26*a* of the exhaust port 26.

Figure 3:
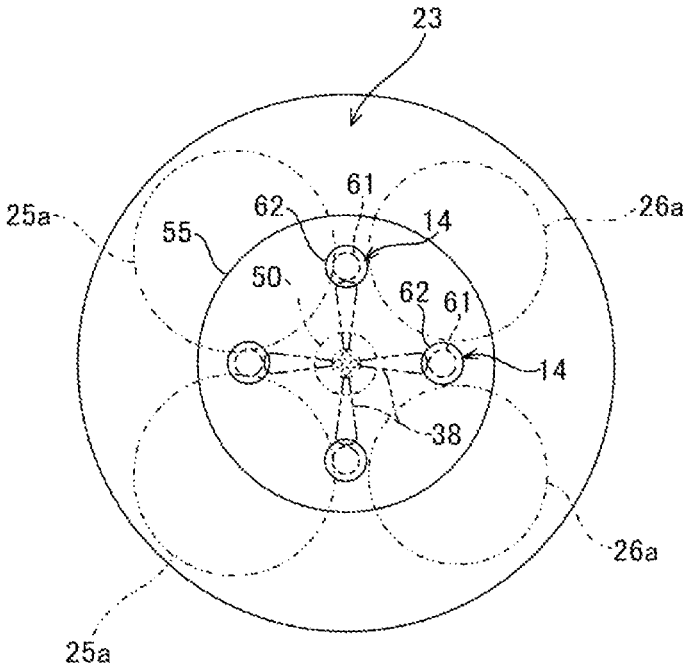
FIG. 3 is a front view of a top surface of a piston according to the first embodiment.

The piston 23 is formed with a cavity 12 that opens at a top surface of the piston 23. The cavity 12 constitutes a part of the combustion chamber 20. As shown in FIG. 3, an opening part 55 of the cavity 12 is circular. A center of the cavity 12 locates at an axial center of the piston 23. A bottom surface 56 of the cavity 12 forms a tapered surface protruding toward a side of the cylinder head 22. Aside surface of the cavity 12 is slightly recessed outwardly. In the piston 23, thermal electron emission members 14 are embedded in a partitioning surface that partitions the combustion chamber 20.

<Fuel Injection Device>

The fuel injection device 40 is attached to the internal combustion engine main body 11, and is adapted to inject fuel to the combustion chamber 20. The fuel injection device 40 is a common rail type fuel injection device. As shown in FIG. 1, the fuel injection device 40 includes the injector 50 provided for each cylinder 24, a pressure accumulator 52 that accumulates high pressure fuel to be supplied to each injector 50, and a supply pump 54 that pressurizes fuel in a fuel tank 53 and supplies it to the pressure accumulator 52. The fuel injection device 40 is controlled by the control device 35.

<Plasma Generation Device>

The plasma generation device 30 feeds the energy of the microwave to the thermal electrons and generates the microwave plasma. The plasma generation device 30 generates the microwave plasma in a plurality of regions in the combustion chamber 20 (a target space). As shown in FIG. 1, the plasma generation device 30 includes an electromagnetic wave emission device 13 and the thermal electron emission members 14. The electromagnetic wave emission device 13 constitutes a heating device that heats the thermal electron emission members 14 by means of an electromagnetic wave.

The electromagnetic wave emission device 13 includes an electromagnetic wave generation device 31, an electromagnetic wave switch 32, and the emission antenna 16. One electromagnetic wave generation device 31 and one electromagnetic wave switch 32 are provided for the electromagnetic wave emission device 13, and the emission antenna 16 is provided for each combustion chamber 20.

The electromagnetic wave generation device 31, upon receiving an electromagnetic wave drive signal (a pulse signal) from the control device 35, continuously outputs a microwave during a period of time of the pulse width of the electromagnetic wave drive signal. In the electromagnetic wave generation device 31, a semiconductor oscillator generates a microwave pulse. In place of the semiconductor oscillator, any other oscillator such as a magnetron may be employed.

The electromagnetic wave switch 32 includes one input terminal and a plurality of output terminals provided for the respective emission antennae 16. The input terminal is electrically connected to the electromagnetic wave generation device 31. Each output terminal is electrically connected to the corresponding emission antenna 16. The electromagnetic wave switch 32 sequentially switches a supply destination of the microwave outputted from the electromagnetic wave generation device 31 from among the plurality of the emission antennae 16 under a control of the control device 35.

The emission antenna 16 is provided on a ceiling surface 51 of the combustion chamber 20. As shown in FIG. 2, the emission antenna 16 is formed in a ring-like shape in front view of the ceiling surface 51 of the combustion chamber 20, and surrounds a tip end part of the injector 50. The emission antenna 16 may be formed in a C-letter shape in front view of the ceiling surface 51 of the combustion chamber 20.

The emission antenna 16 is laminated on an insulation layer 19 formed in a ring-like shape around a mounting hole of the injector 50 on the ceiling surface 51 of the combustion chamber 20. The insulation layer 19 is formed by, for example, thermal spraying of an insulating material. The emission antenna 16 is electrically insulated from the cylinder head 22 by the insulation layer 19. The emission antenna 16 is electrically connected to the output terminal of the electromagnetic wave switch 32 via a transmission line 33 of the microwave embedded in the cylinder head 22.

The thermal electron emission member 14, when heated by the energy of the microwave emitted from the electromagnetic wave emission device 13 to the combustion chamber 20, emits thermal electrons. A plurality of the thermal electron emission members 14 are provided on the bottom surface 56 of the cavity 12, for example. The thermal electron emission members 14 are provided in the same number as the injection holes 39 of the injector 50, for example. As shown in FIG. 3, each thermal electron emission member 14 is arranged at a location where a fuel jet stream 38 that has been injected from each injection hole 39 passes through. Each thermal electron emission member 14 is formed in a disk-like shape. Each thermal electron emission member 14 is fitted into a recess part 57 formed in a circular shape on the bottom surface 56 of the cavity 12. A surface of each thermal electron emission member 14 is approximately flush with the bottom surface 56 of the cavity 12.

Each thermal electron emission member 14 includes an electromagnetic wave absorber 61 and a thermal electron emitter 62. The electromagnetic wave absorber 61 absorbs the microwave emitted by the electromagnetic wave emission device 13, and generates heat. The thermal electron emitter 62 is provided integrally with the electromagnetic wave absorber 61, and is adapted to emit thermal electrons when heated by the heating electromagnetic wave absorber 61. The thermal electron emitter 62 is made of a material (such as a ceramic) that emits thermal electrons at red heat.

The electromagnetic wave absorber 61 is molded with a binder from a material (such as a carbon micro coil) that produces heat by absorbing a microwave. Upon absorbing the microwave, the temperature of the electromagnetic wave absorber 61 is raised above a red heat temperature of the thermal electron emitter 62. The electromagnetic wave absorber 61 is arranged inside of the thermal electron emitter 62. In each thermal electron emission member 14, the electromagnetic wave absorber 61 is held in noncontact with a metallic part of the piston 23, and is not exposed toward the combustion chamber 20.

According to the first embodiment, the electromagnetic wave absorber 61 constitutes a receiving antenna that resonates with the microwave emitted by the electromagnetic wave emission device 13. The electromagnetic wave absorber 61 also serves as an electric field concentration member that concentrates in the vicinity of the thermal electron emission member 14 an electric field of the microwave generated by the electromagnetic wave emission device 13. Inside of the thermal electron emitter 62, the electromagnetic wave absorber 61 is molded in a ring-like shape with an electrically conductive binder. A length of the electromagnetic wave absorber 61 is equal to, for example, a quarter wavelength of the microwave emitted by the electromagnetic wave emission device 13. According to the first embodiment, while the electromagnetic wave emission device 13 heats the thermal electron emission member 14, the electromagnetic wave absorber 61 concentrates the electric field of the microwave in the vicinity of the thermal electron emission member 14, thereby generating the plasma in the vicinity of the thermal electron emission member 14.

<Control Device>

The control device 35 controls the internal combustion engine 10. With regard to the fuel injection device 40, the control device 35 carries out an injection control operation of causing the fuel injection device 40 to perform a pilot injection, a pre-injection, a main injection, an after injection, and a post-injection for one combustion cycle. With regard to the plasma generation device 30, the control device 35 carries out a plasma control operation of causing the plasma generation device 30 to generate the microwave plasma. Hereinafter, a detailed description will be given of the plasma control operation.

The control device 35, upon receiving a start-up instruction (such as an instruction given by a user of a vehicle turning an ignition key) of the internal combustion engine main body 11, starts the plasma control operation before starting a first combustion cycle in the internal combustion engine main body 11. The first combustion cycle is started immediately after the plasma control operation has been started.

The control device 35 carries out, as the plasma control operation, an operation of outputting the electromagnetic wave drive signal to the electromagnetic wave generation device 31. A pulse width of the electromagnetic wave drive signal is set to a predetermined set time interval (such as two seconds). The electromagnetic wave generation device 31, on receiving the electromagnetic wave drive signal, outputs a continuous wave (CW) microwave for the set time interval. The microwave is emitted from the emission antenna 16 for the set time interval.

In each thermal electron emission member 14, the electromagnetic wave absorber 61 absorbs the microwave and generates heat. The electromagnetic wave absorber 61 heats the thermal electron emitter 62. Thus the temperature of the thermal electron emitter 62 is raised to red heat, and emits thermal electrons.

Here, the electromagnetic wave absorber 61 functions as a secondary antenna for the microwave emitted from the emission antenna 16. In the vicinity of a surface of each thermal electron emission member 14, a strong electric field region is formed, which has an electric field relatively strong in intensity in the combustion chamber 20. The thermal electrons emitted from the thermal electron emitter 62 receive the energy of the microwave in the strong electric field region and are accelerated. The accelerated thermal electrons collide with ambient molecules and ionize them. Electrons emitted owing to the ionization are also accelerated by the microwave, and collide with ambient molecules and ionize them. Thus, molecules are ionized in an avalanche-like manner in the strong electric field region. As a result of this, microwave plasma is generated in the vicinity of the surface of each thermal electron emission member 14. The microwave plasma is generated in a plurality of regions.

According to the first embodiment, an output timing of the electromagnetic wave drive signal is configured so that the microwave plasma is generated from immediately before and during the main injection in the first combustion cycle.

In the combustion chamber 20, the fuel jet stream 38 injected from each injection hole of the injector 50 comes into contact with the microwave plasma. The microwave plasma promotes evaporation of the fuel. Furthermore, active species such as OH radicals are generated in the regions where the microwave plasma is generated. Accordingly, the active species promotes combustion of the fuel that has been compressed ignited.

According to the first embodiment, since the microwave plasma is generated in the plurality of regions in the combustion chamber 20, the evaporation and combustion of the fuel are promoted in the plurality of regions. Therefore, an amount of unburned fuel emission from the combustion chamber 20 is decreased in the first combustion cycle. Furthermore, since an amount of heat generation is increased as a result of the fact that a large amount of fuel is combusted, the temperature of the internal combustion engine main body 11 rapidly increases after the first combustion cycle. Accordingly, an amount of unburned fuel emission from the combustion chamber 20 is decreased also in and after the second combustion cycle.

The control device 35 outputs the electromagnetic wave drive signal during the intake stroke also in and after the second combustion cycle, as the plasma control operation. The pulse width of the electromagnetic wave drive signal is configured to be shorter in and after the second combustion cycle than in the first combustion cycle. The output timing of the electromagnetic wave drive signal is configured in such a manner that the microwave plasma is generated from immediately before and during the main injection, similarly to the first combustion cycle. When the temperature of the internal combustion engine main body 11 reaches a predetermined set temperature, the control device does not carry out the plasma control operation any more in the subsequent combustion cycles.

<Effect of First Embodiment>

According to the first embodiment, the thermal electrons are emitted to the combustion chamber 20 by utilizing the energy of the microwave emitted by the electromagnetic wave emission device 13. Accordingly, as a device which necessitates electrical wirings, a glow plug which has been required for the conventional plasma generation device is not required any more. This means that plasma can be generated if at least the electromagnetic wave emission device 13 is provided. Therefore, it is possible to simplify a configuration of the plasma generation device 30 that generates plasma by means of an electromagnetic wave using thermal electrons as a trigger.

Furthermore, according to the first embodiment, at a start-up time of the internal combustion engine main body 11, the microwave plasma is generated in a plurality of regions in the combustion chamber 20, so as to decrease an amount of unburned fuel emission discharged from the combustion chamber 20. Accordingly, it is possible to compactly configure a purifier (such as a three way catalyst) in an exhaust passage connected to the internal combustion engine main body 11.

First Modified Example of First Embodiment

Figure 4:
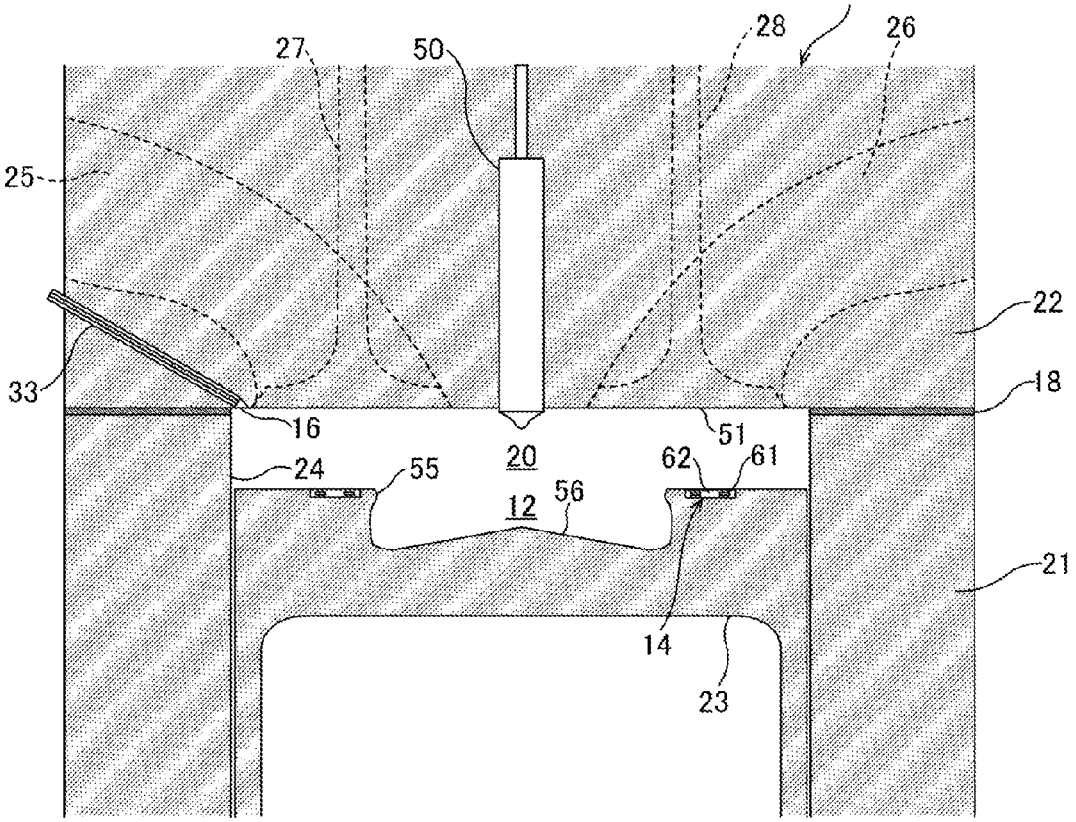
FIG. 4 is a cross sectional view of an internal combustion engine according to a first modified example of the first embodiment.

According to the first modified example of the first embodiment, as shown in FIG. 4, the emission antenna 16 is disposed at a location close to an outer circumference of the ceiling surface 51 of the combustion chamber 20. Accordingly, when the plasma generation device 30 generates the microwave plasma, the microwave is prevented from being absorbed by the fuel jet stream 38, and it is possible to utilize a larger amount of energy of the microwave for generating the microwave plasma. Here, a plurality of emission antennae 16 may be provided on the ceiling surface 51 of the combustion chamber 20.

Furthermore, a thermal electron emission member 14 may be disposed on an outside area of the opening part 55 of the cavity 12 on the top surface of the piston 23.

Furthermore, a thermal electron emission member 14 may be disposed on a tip end surface of the injector 50. In this case, it is possible to remove deposits attached to the tip end surface of the injector 50 by the plasma.

Second Modified Example of First Embodiment

Figure 5:
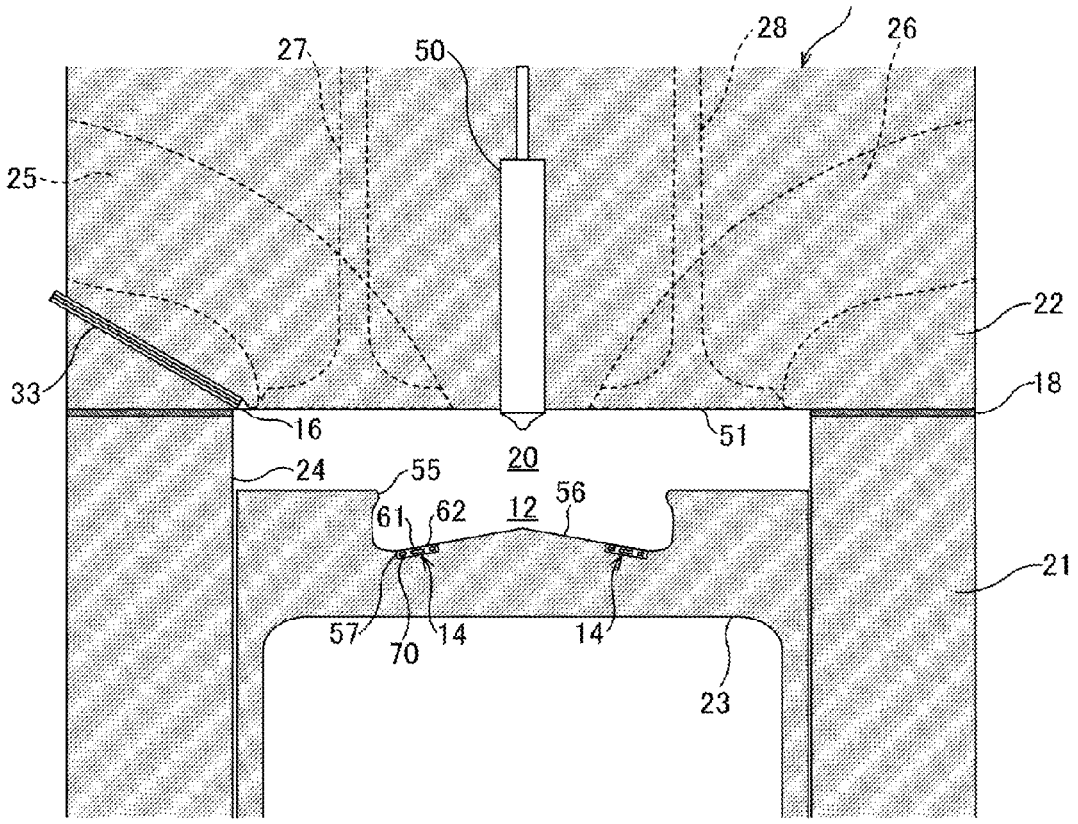
FIG. 5 is a cross sectional view of an internal combustion engine according to a second modified example of the first embodiment.

According to the second modified example of the first embodiment, as shown in FIG. 5, an electric field concentration member 70, which constitutes a secondary antenna for resonating with the microwave emitted from the emission antenna 16, is provided separately from the electromagnetic wave absorber 61. The electromagnetic wave absorber 61 is a carbon micro coil molded with a binder in a disk-like shape.

The electric field concentration member 70 is provided for each thermal electron emission member 14. The electric field concentration member 70 is, for example, a ring-like shaped conductor. The electric field concentration member 70 is embedded in the thermal electron emitter 62 in a manner to surround the electromagnetic wave absorber 61. A length of the electric field concentration member 70 is equal to, for example, a quarter wavelength of the microwave emitted by the electromagnetic wave emission device 13.

According to the second modified example of the first embodiment, when the microwave is emitted from the emission antenna 16, a strong electric field region is formed in the vicinity of the electric field concentration member 70. This means that the strong electric field region is formed in the vicinity of a surface of the thermal electron emission member 14. Therefore, the thermal electrons emitted from the thermal electron emitter 62 are accelerated in the strong electric field region, and the microwave plasma is generated similarly to the first modified example.

Second Embodiment

Figure 6:
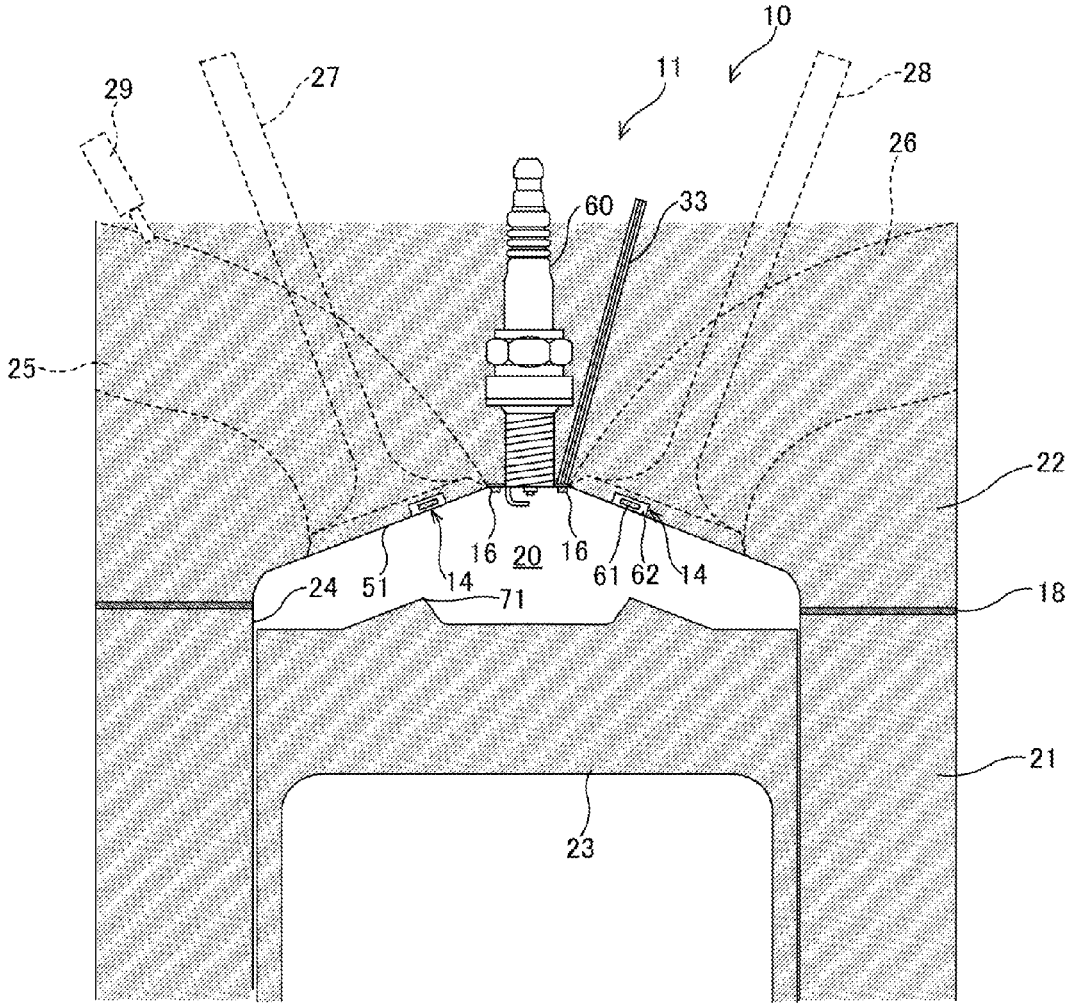
FIG. 6 is a cross sectional view of an internal combustion engine according to a second embodiment.

The second embodiment is directed to a spark ignition type internal combustion engine 10, as shown in FIG. 6. The internal combustion engine 10 includes an internal combustion engine main body 11, an ignition device 60, and a plasma generation device 30. According to the second embodiment, similarly to the first embodiment, a plurality of thermal electron emission members 14 are provided in the internal combustion engine main body 11.

Each thermal electron emission member 14 is disposed between two adjacent openings from among the four of the intake side openings 25*a* and the exhaust side openings 26*a*. Each thermal electron emission member 14 faces toward a ridge of a circular salient part 71 formed on the top surface of the piston 23. The salient part 71 forms a crater-like recess on the top surface of the piston 23.

Similarly to the first embodiment, at the start-up time of the internal combustion engine main body 11, the plasma generation device 30 starts heating each thermal electron emission member 14 before the start of the combustion cycle in which the air fuel mixture is combusted in the combustion chamber 20, and generates microwave plasma in the combustion chamber 20 during the combustion cycle.

More particularly, the plasma generation device 30 starts emitting the microwave from the emission antenna 16 before the start of the combustion cycle. In the thermal electron emission member 14, the electromagnetic wave absorber 61 is heated, and the thermal electron emitter 62 emits the thermal electrons. In the first combustion cycle, the microwave emission is continued until the compression top dead center is reached where the salient part 71 approaches to the thermal electron emission members 14. At a crank angle near the compression top dead center, a strong electric field region is formed in the vicinity of the ridge of the salient part 71. The strong electric field region is formed in a manner to include a surface of each thermal electron emission member 14. Accordingly, the thermal electrons emitted from each thermal electron emission member 14 are accelerated in the strong electric field region, and the microwave plasma is generated.

Third Embodiment

According to the third embodiment, unlike the first and second embodiments, a principle of induction heating is employed to heat the thermal electron emission member 14 and cause the thermal electron emission member 14 to emit thermal electrons.

Figure 7:
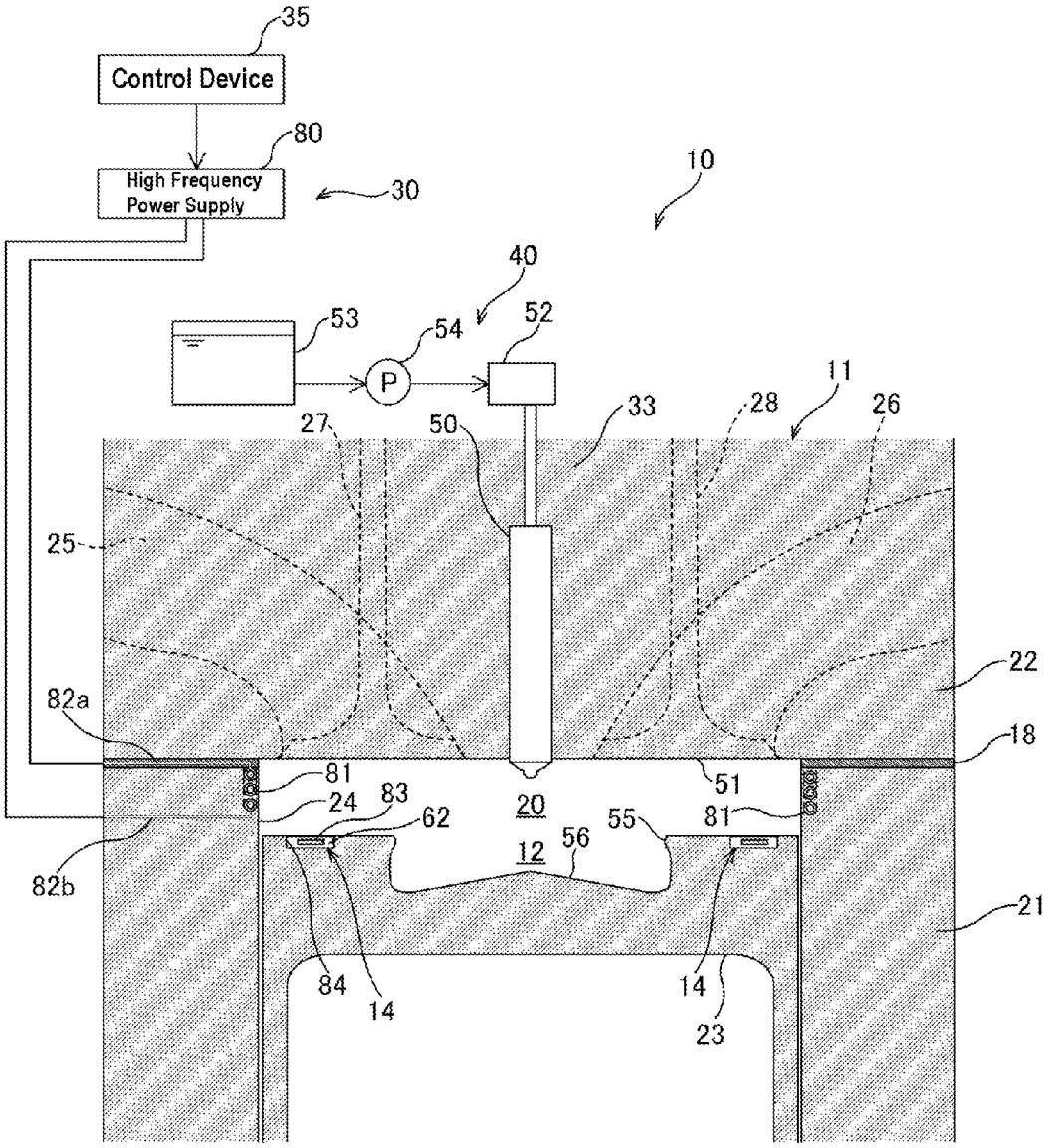
FIG. 7 is a cross sectional view of an internal combustion engine according to a third embodiment.

As shown in FIG. 7, the plasma generation device 30 includes a high frequency power supply 80, a heating coil 81, and a thermal electron emission member 14. The high frequency power supply 80 (an alternating current power supply) supplies an alternating current power to the heating coil 81 via a first lead wire 82*a* and a second lead wire 82*b*.

The heating coil 81 is embedded in the cylinder block 21 in the vicinity of a wall surface of the combustion chamber 20. The heating coil 81 is wound up along the wall surface of the combustion chamber 20. The heating coil 81 is connected at an upper end thereof to the first lead wire 82*a*. The heating coil 81 is connected at a lower end thereof to the second lead wire 82*b*. The heating coil 81 is covered by an insulator (such as a ceramic) over an entire length thereof.

The first lead wire 82*a* and the second lead wire 82*b* are covered by a heat resistant insulator (such as a ceramic). The first lead wire 82*a* is embedded in the gasket 18.

The thermal electron emission member 14 includes an induction heater 83 and a thermal electron emitter 62. The induction heater 83 is a ring-like shaped conductor. The induction heater 83 is, for example, a conductor layer of a carbon micro coil fixed by a binder. Although an electrically conductive binder is employed for the conductor layer 83, an electrically non-conductive binder may be employed, provided that the mixing ratio of the carbon micro coil is increased. A powder of aluminum, copper, silicon carbide or the like may be mixed in the conductor layer 83. By mixing an easily-oxidizable powder such as copper in the conductor layer 83, it is possible to suppress oxidization of the carbon micro coil in the conductor layer 83.

As the induction heater 83, a material is employed having a higher electrical resistance in comparison with constituent parts of the internal combustion engine main body 11 (the cylinder block, the cylinder head, and the piston). For example, in a case in which the constituent parts of the internal combustion engine main body 11 are made of aluminum, it is possible to employ carbon, iron, tungsten, or the like as the induction heater 83. A semiconductor may also be employed as the induction heater 83.

The induction heater 83 is embedded in the ring-like shaped thermal electron emitter 62 (such as a ceramic). The thermal electron emitter 62 is fitted in a ring-like shaped recess part 84 on the top surface of the piston 23. The thermal electron emitter 62 is disposed on an outside area of the opening part 55 of the cavity 12 on the top surface of the piston 23. The thermal electron emitter 62 may be disposed on another location such as the bottom surface 56 of the cavity 12.

In the plasma generation device 30, when a high power alternating current of several tens to several hundred megahertz (MHz) is supplied from the high frequency power supply 80 to the heating coil 81, magnetic flux inside of the heating coil 81 varies, and an induced current flows through the induction heater 83. The induction heater 83 generates heat owing to the induced current. The thermal electron emitter 62 is heated with the heat generated by the induction heater 83. Then, a temperature of the thermal electron emitter 62 is raised above red heat, and thermal electrons are emitted from the thermal electron emitter 62.

The thermal electrons emitted from the thermal electron emitter 62 absorb energy of an electromagnetic wave and are accelerated in the strong electric field region where the electromagnetic wave inside of the heating coil 81 concentrates. The accelerated thermal electrons collide with and ionize molecules. Electrons emitted by the ionization also absorb the energy of the electromagnetic wave, are accelerated, and collide with and ionize molecules. An avalanche-like molecule ionization occurs in the strong electric field region. Thus, according to the third embodiment, plasma is generated inside of the heating coil 81.

When the temperature of the induction heater 83 is raised to some extent, the electrical resistance of the induction heater 83 is reduced, and then, the energy of the electromagnetic wave consumed in the induction heater 83 is decreased. Therefore, after the induction heater 83 becomes high in temperature and the thermal electron emitter 62 starts to emit the thermal electrons, the energy of the electromagnetic wave inside of the heating coil 81 is consumed mainly for acceleration of the electrons.

It may be possible to arrange an electric field concentration member (such as a protrusion) that concentrates an electric field of the electromagnetic wave in the vicinity of the thermal electron emission member 14. Alternatively, the induction heater 83 may be formed in a shape that can concentrate the electric field of the electromagnetic wave. For example, induction heater 83 may be partially formed with protrusions. As a result of this, it is possible to generate plasma even though the output power of the high frequency power supply 80 is reduced.

Other Embodiments

The embodiments described above may also be configured as follows.

In the embodiments described above, the emission antenna 16 may be utilized as the electric field concentration member by arranging the thermal electron emission member 14 in the vicinity of the emission antenna 16.

Furthermore, in the embodiments described above, the thermal electron emission member 14 may be configured by a single material that absorbs the microwave emitted by the electromagnetic wave emission device 13, generates heat, and as well emits thermal electrons due to the heat. For example, the thermal electron emission member 14 may be configured by a ceramic. The ceramic absorbs the microwave and generates heat. Furthermore, when the temperature of the ceramic is raised above red heat, the ceramic emits thermal electrons caused by the heat.

Furthermore, in the embodiments described above, the plasma generation device 30 may generate the microwave plasma in a plurality of regions in the combustion chamber 20 at timings other than the start-up time of the internal combustion engine main body 11.

Furthermore, in the embodiments described above, the internal combustion engine 10 may be an HCCI (Homogeneous Charge Compression Ignition) engine. In this case, the plasma generation device 30 may generate the microwave plasma in order to reduce an amount of unburned fuel emission in a plurality of combustion cycles at the start-up time of the internal combustion engine main body 11. Furthermore, the plasma generation device 30 may generate the microwave plasma in order to control an ignition timing in every combustion cycle while the internal combustion engine main body 11 is operating.

Furthermore, in the embodiments described above, the electromagnetic wave generation device 31 may output the microwave in a pulse wave mode in place of the continuous wave (CW) mode.

Furthermore, in the embodiments described above, the plasma generation device 30 generates non-equilibrium plasma. However, the plasma generation device 30 may generate thermal plasma. In this case, in comparison with the embodiments described above, evaporation of sprayed fuel is promoted although an effect of promoting chemical reaction by the radicals is reduced.

Furthermore, in the embodiments described above, a heat insulation material or a space for heat insulation may be provided around each thermal electron emission member 14. In this case, it is possible for the thermal electron emission member 14 to emit the thermal electrons with a less amount of energy of the microwave. Especially, in and after the second combustion cycle, it is possible to emit the thermal electrons with a less amount of energy of the microwave.

Furthermore, in the embodiments described above, as the electromagnetic wave absorber 61, such a material may be employed that decreases in microwave absorption characteristic when its temperature is raised above red heat temperature of the thermal electron emitter 62.

INDUSTRIAL APPLICABILITY

The present invention is useful in relation to a plasma generation device that generates plasma by means of an electromagnetic wave using thermal electrons as a trigger and an internal combustion engine provided with the plasma generation device.

EXPLANATION OF REFERENCE NUMERALS

10 Internal Combustion Engine
11 Internal Combustion Engine Main Body
13 Electromagnetic Wave Emission Device (Heating Device)
14 Thermal Electron Emission Member
16 Emission Antenna
20 Combustion Chamber
30 Plasma Generation Device
57 Recess Part
61 Electromagnetic Wave Absorber (Electric Field Concentration Member)
62 Thermal Electron Emitter

What is claimed is:

1. A plasma generation device, comprising:

a thermal electron emission member that emits thermal electrons when heated;

a heating device that emits an electromagnetic wave to a space where the thermal electron emission member is disposed such that the thermal electron emission member is heated by means of the electromagnetic wave; and an electric field concentration member that concentrates an electric field of the electromagnetic wave generated by the heating device in the vicinity of the thermal electron emission member, wherein the thermal electron emission member comprises:

an electromagnetic wave absorber that absorbs the electromagnetic wave emitted by the heating device and generates heat; and a thermal electron emitter that emits the thermal electrons when heated by the electromagnetic wave absorber that has generated heat, the thermal electron emitter being integrally formed with the electromagnetic wave absorber, and the heating device heats the thermal electron emission member to emit thermal electrons, and the electric field concentration member concentrates the electric field of the electromagnetic wave in the vicinity of the thermal electron emission member, thereby generating plasma in the vicinity of the thermal electron emission member.

2. The plasma generation device according to claim 1, wherein the electromagnetic wave absorber constitutes a receiving antenna that resonates with the electromagnetic wave emitted by the heating device.

3. The plasma generation device according to claim 1, wherein the heating device includes a heating coil which alternating current power is supplied to, and is adapted to inductively heat the thermal electron emission member located inside of the heating coil.

4. An internal combustion engine including:

the plasma generation device according to claim 1; and an internal combustion engine main body formed with a combustion chamber, wherein the thermal electron emission member and the electric field concentration member are disposed on a partitioning surface of the combustion chamber in the internal combustion engine main body, and the plasma generation device, while causing the heating device to heat and cause the thermal electron emission member to emit thermal electrons, causes the electric field concentration member to concentrate an electric field of the electromagnetic wave in the vicinity of the thermal electron emission member, thereby generating plasma in the vicinity of the thermal electron emission member in the combustion chamber.

5. The internal combustion engine according to claim 4, wherein the plasma generation device includes a plurality of thermal electron emission members arranged in respective regions different from one another on the partitioning surface, and the plasma generation device generates plasma in the vicinities of the respective thermal electron emission members.

6. The internal combustion engine according to claim 4, wherein at a start-up time of the internal combustion engine main body, the plasma generation device starts heating the thermal electron emission member before a combustion cycle is started in which an air fuel mixture is combusted in the combustion chamber, and generates plasma in the combustion chamber during the combustion cycle.

7. An internal combustion engine including:

the plasma generation device according to claim 1; and an internal combustion engine main body formed with a combustion chamber, wherein the thermal electron emission member and the electric field concentration member are disposed on a partitioning surface of the combustion chamber in the internal combustion engine main body, and the plasma generation device, while causing the heating device to heat and cause the thermal electron emission member to emit thermal electrons, causes the electric field concentration member to concentrate an electric field of the electromagnetic wave in the vicinity of the thermal electron emission member, thereby generating plasma in the vicinity of the thermal electron emission member in the combustion chamber.

8. An internal combustion engine including:

the plasma generation device according to claim 2; and an internal combustion engine main body formed with a combustion chamber, wherein the thermal electron emission member and the electric field concentration member are disposed on a partitioning surface of the combustion chamber in the internal combustion engine main body, and the plasma generation device, while causing the heating device to heat and cause the thermal electron emission member to emit thermal electrons, causes the electric field concentration member to concentrate an electric field of the electromagnetic wave in the vicinity of the thermal electron emission member, thereby generating plasma in the vicinity of the thermal electron emission member in the combustion chamber.

9. An internal combustion engine including:

the plasma generation device according to claim 3; and an internal combustion engine main body formed with a combustion chamber, wherein the thermal electron emission member and the electric field concentration member are disposed on a partitioning surface of the combustion chamber in the internal combustion engine main body, and the plasma generation device, while causing the heating device to heat and cause the thermal electron emission member to emit thermal electrons, causes the electric field concentration member to concentrate an electric field of the electromagnetic wave in the vicinity of the thermal electron emission member, thereby generating plasma in the vicinity of the thermal electron emission member in the combustion chamber.

10. The internal combustion engine according to claim 5, wherein at a start-up time of the internal combustion engine main body, the plasma generation device starts heating the thermal electron emission member before a combustion cycle is started in which an air fuel mixture is combusted in the combustion chamber, and generates plasma in the combustion chamber during the combustion cycle.

* * * * *